US009698526B2

(12) United States Patent
Kawashima

(10) Patent No.: US 9,698,526 B2
(45) Date of Patent: Jul. 4, 2017

(54) CONNECTOR WITH ALIGNING PLATE

(71) Applicant: YAZAKI CORPORATION, Tokyo (JP)

(72) Inventor: Kenichi Kawashima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/177,590

(22) Filed: Jun. 9, 2016

(65) Prior Publication Data

US 2016/0372865 A1 Dec. 22, 2016

(30) Foreign Application Priority Data

Jun. 19, 2015 (JP) ..... 2015-123387

(51) Int. Cl.
*H01R 13/631* (2006.01)

(52) U.S. Cl.
CPC ..... *H01R 13/631* (2013.01)

(58) Field of Classification Search
CPC ..... H01R 13/405; H01R 12/57; H01R 12/59; H01R 12/7005; H01R 12/7058; H01R 12/724; H01R 13/111; H01R 13/18; H01R 13/187; H01R 13/504; H01R 13/62; H01R 13/631; H01R 13/6581; H01R 13/6593
See application file for complete search history.

(56) References Cited

U.S. PATENT DOCUMENTS 5,023,752 A * 6/1991 Detter ..... H05K 7/026 361/646
2001/0027039 A1* 10/2001 Okabe ..... H01R 12/7005 439/79
2005/0059302 A1* 3/2005 Sablatzky ..... H01R 29/00 439/701
2006/0019515 A1* 1/2006 Takagi ..... H01R 12/724 439/79
2009/0203248 A1 8/2009 Matsumura et al.
2012/0149228 A1* 6/2012 Matsumoto ..... H01R 13/4223 439/329
2016/0181747 A1* 6/2016 Gao ..... H01R 24/64 439/620.21
2017/0069984 A1* 3/2017 Miura ..... H01R 12/724

FOREIGN PATENT DOCUMENTS

JP 2009-187865 A 8/2009

* cited by examiner

*Primary Examiner* — Truc Nguyen
(74) *Attorney, Agent, or Firm* — Kenealy Vaidya LLP

(57) ABSTRACT

A connector with an aligning plate, includes plural male terminals, a connector housing that houses the male terminals therein and is formed so that a counterpart connector is inserted thereinto, an aligning plate that is provided so as to be movable in an insertion direction of the counterpart connector into the connector housing. The connector housing includes a pair of provisional locking arms which hold the aligning plate at a provisional locking position, and the aligning plate includes provisional locking portions which engage with the pair of provisional locking arms. The connector housing and the aligning plate are provided with plural recesses and plural projections which are mutually engageable and which restrict a warp of the aligning plate in the insertion direction.

3 Claims, 12 Drawing Sheets

CONNECTOR WITH ALIGNING PLATE

CROSS REFERENCE TO RELATED APPLICATIONS

This application is based on Japanese Patent Application (No. 2015-123387) filed on Jun. 19, 2015, the contents of which are incorporated herein by reference.

BACKGROUND OF THE INVENTION

1. Field of the Invention

The present invention relates to a connector with an aligning plate which supports male terminals and thereby positions them at prescribed positions and protects them.

2. Description of the Related Art

For example, a technique relating to a connector for electrical connection is known which is disclosed in JP-A-2009-187865.

The connector disclosed in JP-A-2009-187865 includes a male connector which is provided for terminals of one bundle of cables and a female connector which is provided for terminals of the other bundle of cables. The female connector includes a female connector housing having a hood and a male terminal housing portion and a number of male terminals housed in the female connector housing. Where the number of male terminals are large, the female connector is further equipped with an aligning plate. The aligning plate is provided to position and protect male electric contact portions (male tabs) of the male terminals that project into the hood of the female connector housing in a state that the male connector is not fitted in the female connector. The aligning plate is attached to provisional locking arms in a provisional locking manner. The provisional locking arms are provided inside the hood.

FIGS. 7 to 12 show another example connector 100 devised by employing the technique disclosed in JP-A-2009-187865. The connector 100 includes a connector housing 101 having a hood 103 and a male terminal housing portion 104, a number of male terminals (not shown) housed in the connector housing 101, and an aligning plate 102 for positioning and protecting male electric contact portions of the male terminals that project into the hood 103 of the connector housing 101.

As illustrated in FIG. 11, a pair of inner wall surfaces 105 and 106 extending in the shorter-axis direction of the connector housing 101 among the inner wall surfaces of the hood 103 of the connector housing 101 are formed with provisional locking arms 107 which allow the aligning plate 102 to be attached so as to be placed at a provisional locking position. The provisional locking arms 107 have respective engagement projections 109 which project to the inside of the connector housing 101 from their tips and are engaged with respective provisional locking portions 108 of the aligning plate 102.

Now, a description will be made of work of provisionally locking the aligning plate 102 inside the connector housing 101. First, the aligning plate 102 is moved in the direction indicated by arrow P in FIG. 7 and thereby inserted into the hood 103 of the connector housing 101. Then the aligning plate 102 is further inserted deep into the hood 103 (i.e., toward the male terminal housing portion 104), whereby as illustrated in FIG. 11 the provisional locking arms 107 are engaged with the provisional locking portions 108 of the aligning plate 102 when the aligning plate 102 has reached an approximately middle position of the inside space of the hood 103.

Since as described above the aligning plate 102 is provisionally locked on the provisional locking arms 107, the male electric contact portions of the male terminals that project into the hood 103 of the connector housing 101 can be positioned and protected in a state that a counterpart connector (not shown) is not fitted in the connector 100.

In the connector 100 illustrated in FIGS. 7-12, if a handling person pushes the aligning plate 102 in the direction indicated by arrow T in FIG. 10 with, for example, his or her finger in a state that the aligning plate 102 is provisionally locked on the connector housing 101, the aligning plate 102 is warped in the insertion direction (indicated by arrow T in FIG. 10) of the counterpart connector as indicated by imaginary lines in FIG. 10. At the same time, as indicated in FIG. 11, both end portions, in its longitudinal direction, of the aligning plate 102 rotate in the directions indicated by arrow U in FIG. 11 with the tips of the engagement projections 109 of the provisional locking arms 107 as rotation axes. As a result, the engagement widths (margins) of the provisional locking portions 108 of the aligning plate 102 and the engagement projections 109 of the provisional locking arms 107 are shortened.

If the aligning plate 102 is pushed further in the insertion direction of the counterpart connector, both end portions of the aligning plate 102 rotate further in the directions indicated by arrow U in FIG. 12 with the tips of the engagement projections 109 of the provisional locking arms 107 as rotation axes. As indicated by imaginary lines in FIG. 12, this results in a problem that the provisional locking portions 108 of the aligning plate 102 are disengaged from the engagement projections 109 of the provisional locking arms 107.

This problem means that the aligning plate 102 that has been disengaged from the provisional locking arms 107 may fall to the deep side of the connector housing 101.

Furthermore, when the aligning plate 102 has fallen to the deep side the connector housing 101, a problem arises that the aligning plate 102 can no longer protect the male terminals or position them at the prescribed positions.

SUMMARY OF THE INVENTION

The present invention has been made in view of the above circumstances, and an object of the invention is therefore to provide a connector with an aligning plate which can maintain the engagement between the alignment plate and the provisional locking arms.

To solve the above problems, as recited in a first aspect, the invention provides a connector with an aligning plate including:

plural male terminals configured to come into electrically contact with terminals of a counterpart connector;

a connector housing that houses the male terminals therein and is formed so that the counterpart connector is inserted thereinto; and an aligning plate that is provided so as to be movable in an insertion direction of the counterpart connector into the connector housing and that positions tip portions of the male terminals in the connector housing, wherein the connector housing includes a pair of provisional locking arms which hold the aligning plate at a provisional locking position, and the aligning plate includes provisional locking portions which engage with the pair of provisional locking arms; and wherein the connector housing and the aligning plate are provided with plural recesses and plural projections which are mutually engageable and which restrict a warp of the aligning plate in the insertion direction.

According to this aspect of the invention, since the connector housing and the aligning plate are provided with plural recesses and plural projections, the recesses are fitted with the respective projections, whereby a warp of the aligning plate in the insertion direction of the counterpart connector is restricted.

As recited in a second aspect, the invention provides a connector with an aligning plate according to the first aspect in which the recesses and the projections are provided at positions near the provisional locking arms and the provisional locking portions.

According to this aspect of the invention, since the recesses and projections are provided at positions near the provisional locking arms and the provisional locking portions, a warp of the aligning plate in the insertion direction of the counterpart connector near the positions where the provisional locking arms are engaged with the provisional locking portions is restricted.

As recited in a third aspect, the invention provides a connector with an aligning plate according to the first or second aspect in which the projections are formed in inner wall surfaces of the connector housing and shaped like ribs extending in the insertion direction, and the recesses are formed in outer edges of the aligning plate so as to guide the projections.

In this aspect of the invention, the projections and shaped like ribs that extend in the insertion direction and the recesses have such a shape as to guide the respective projections.

According to the first aspect of the invention, even if the aligning plate is pushed in the insertion direction of the counterpart connector in a state that the aligning plate is engaged with the provisional locking arms, a warp of the aligning plate in the insertion direction of the counterpart connector can be restricted because the recesses and the projections formed in the connector housing and the aligning plate are fitted with/in each other. As a result, the aligning plate can be prevented from being disengaged from the provisional locking arms. This provides an advantage that the engagement between the alignment plate and the provisional locking arms can be maintained.

This also provides an advantage that the protection of the male terminals and the positioning of them at prescribed positions by the aligning plate are made reliable.

According to the second aspect of the invention, since a warp of the aligning plate in the insertion direction of the counterpart connector near the positions where the provisional locking arms are engaged with the provisional locking portions is restricted, the provisional locking portions can be prevented more reliably from being disengaged from the provisional locking arms even if the aligning plate is pushed in the insertion direction of the counterpart connector. This provides an advantage that the engagement between the alignment plate and the provisional locking arms can be maintained more reliably.

According to the third aspect of the invention, since the projections are shaped like ribs that extend in the insertion direction, the projections are not disengaged from the respective recesses in the connector housing even if the aligning plate is forced to warp in the insertion direction. As a result, the engagement between the provisional locking arms and the provisional locking portions can be maintained more reliably. This means that the engagement between the alignment plate and the provisional locking arms can be maintained more reliably.

Furthermore, since the projections are shaped like ribs that extend in the insertion direction and the recesses are formed so as to guide the respective projections, this aspect of the invention provides an advantage that the efficiency of work of attaching the aligning plate to the connector housing is increased.

Still further, since the projections are shaped like ribs that extend in the insertion direction, this aspect of the invention provides an advantage that a connector housing manufacturing die can be opened without causing any trouble. This means increased connector manufacturing efficiency.

DETAILED DESCRIPTION OF THE EXEMPLARY EMBODIMENTS

A connector with an aligning plate according to an embodiment of the present invention will be hereinafter described with reference to FIGS. 1-6.

Figure 1:
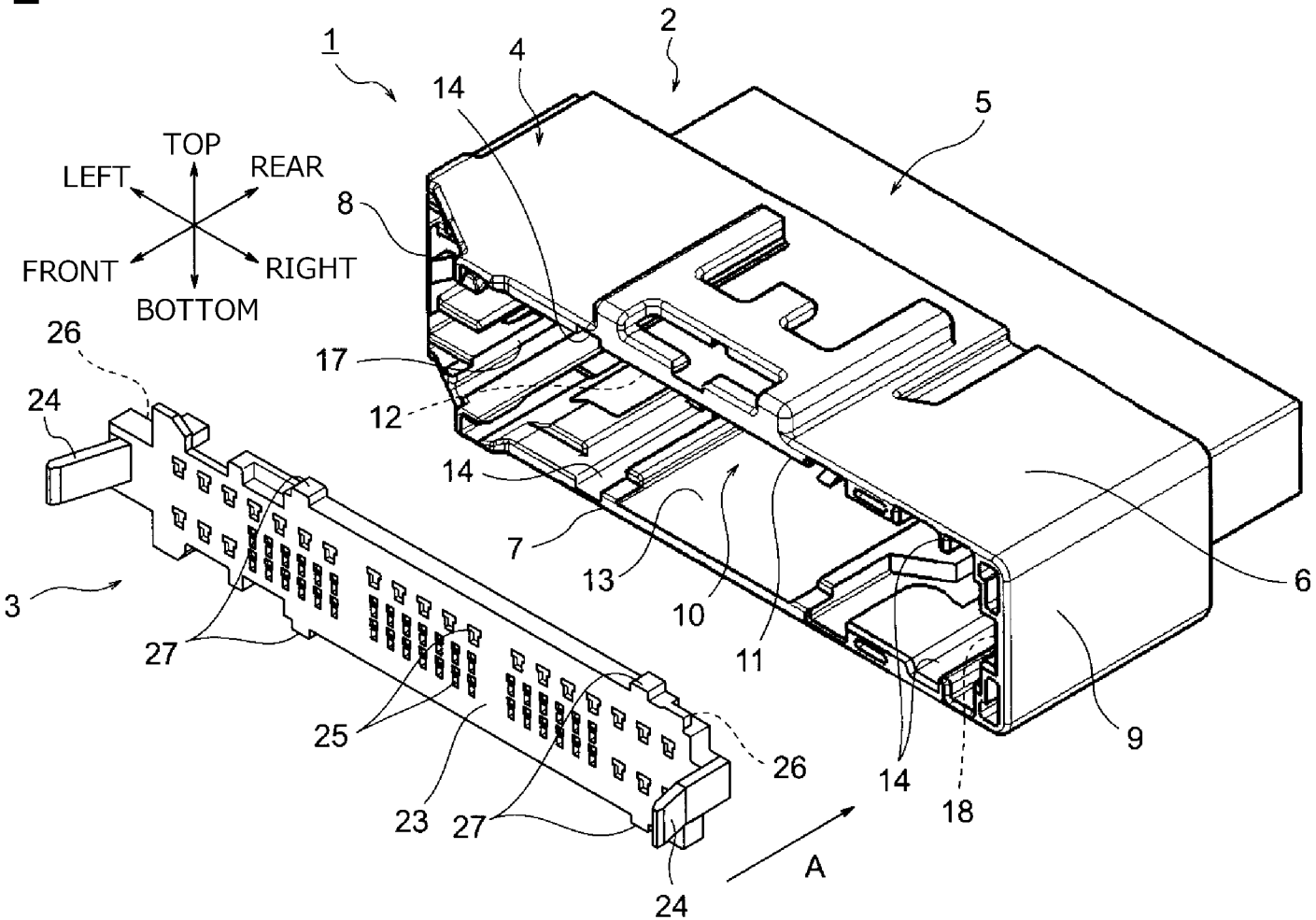
FIG. 1 is an exploded perspective view of a connector with an aligning plate according to an embodiment of the present invention.
Figure 4:
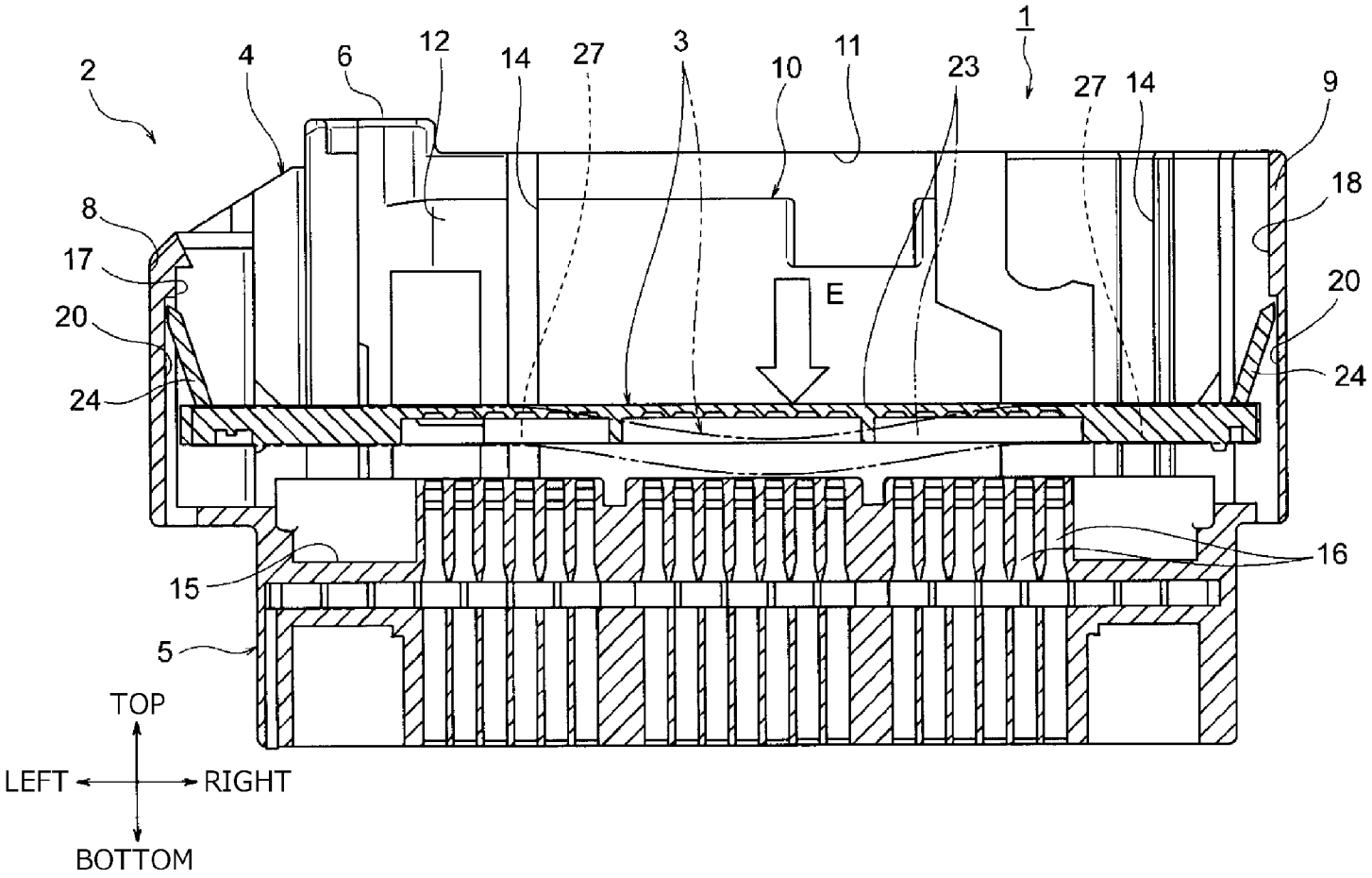
FIG. 4 is a sectional view of the connector along line C-C in FIG. 2.
Figure 5:
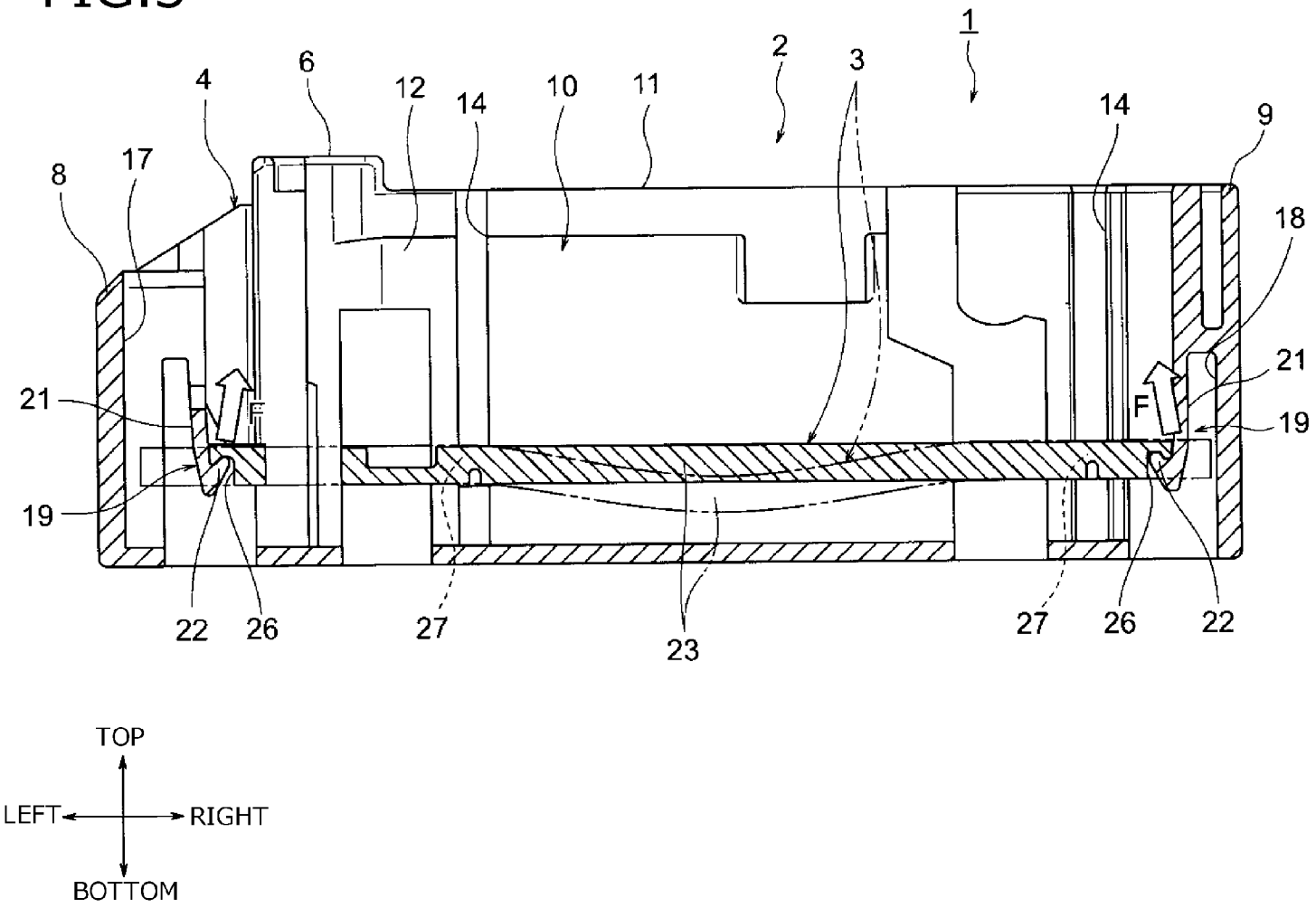
FIG. 5 is a sectional view of the connector along line D-D in FIG. 2.
Figure 6:
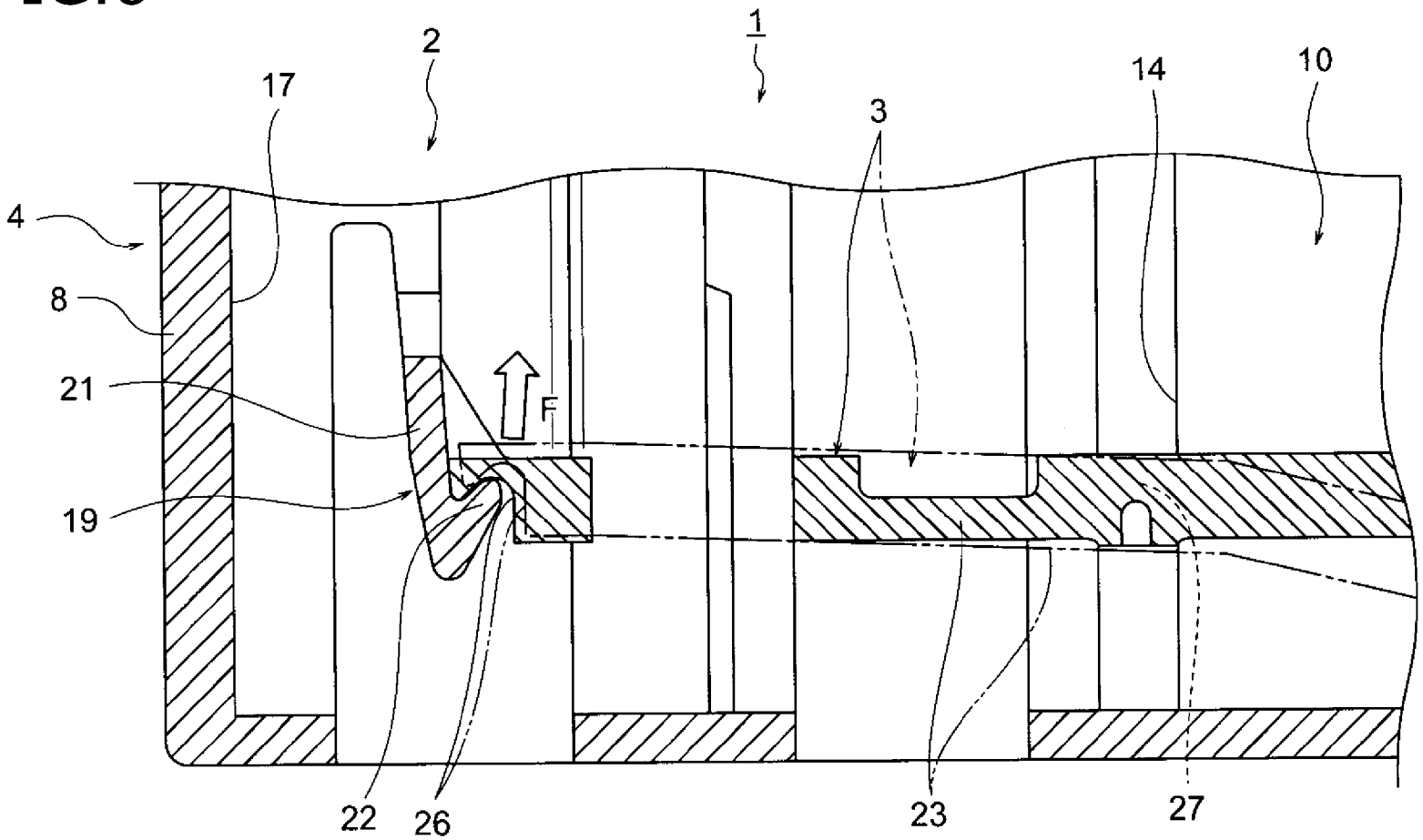
FIG. 6 is an enlarged view of a part of the connector in FIG. 5 in which an aligning plate is engaged with provisional locking arms.
Figure 7:
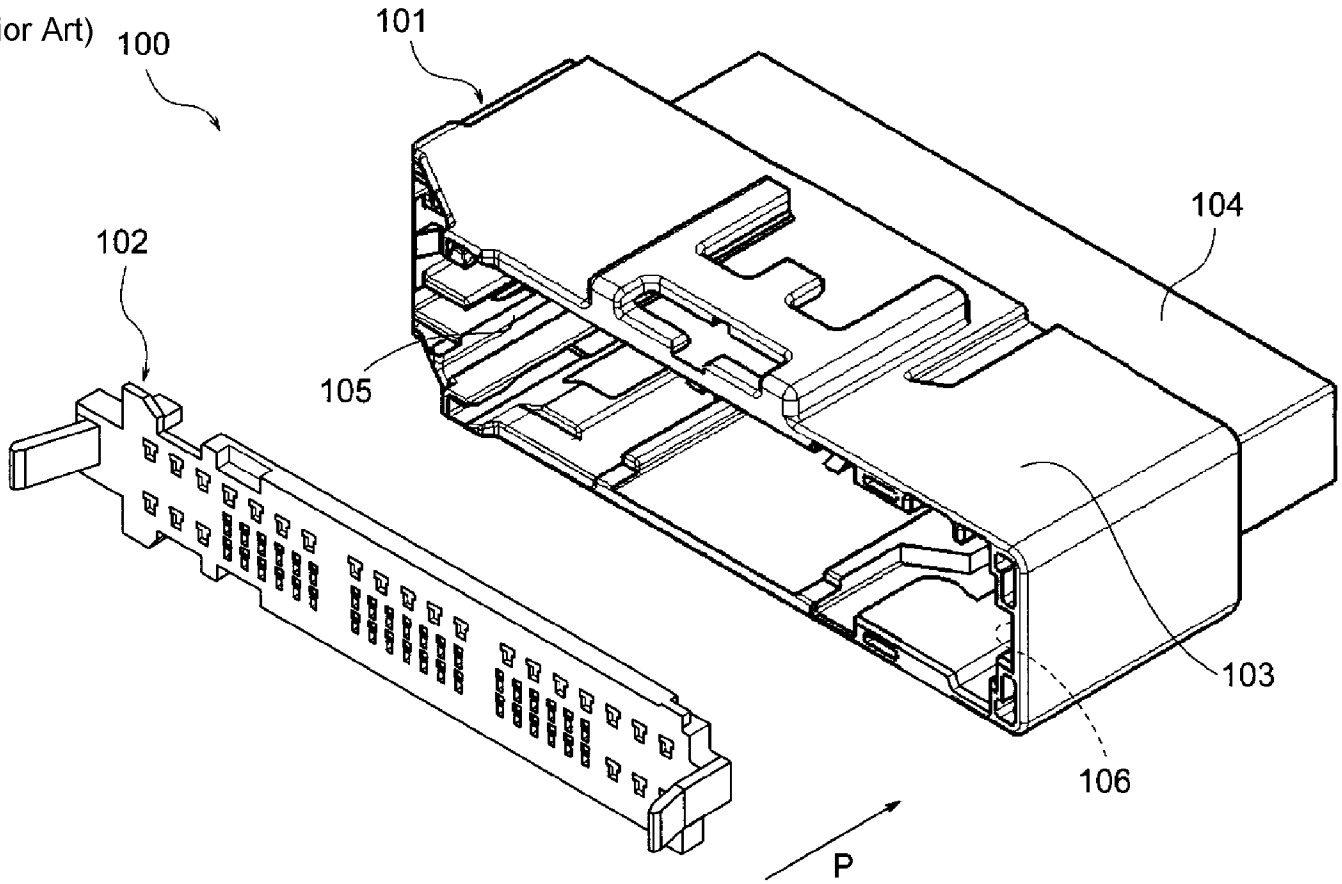
FIG.7 (Prior Art)
FIG. 7 is an exploded perspective view of a related connector with an aligning plate.
Figure 8:
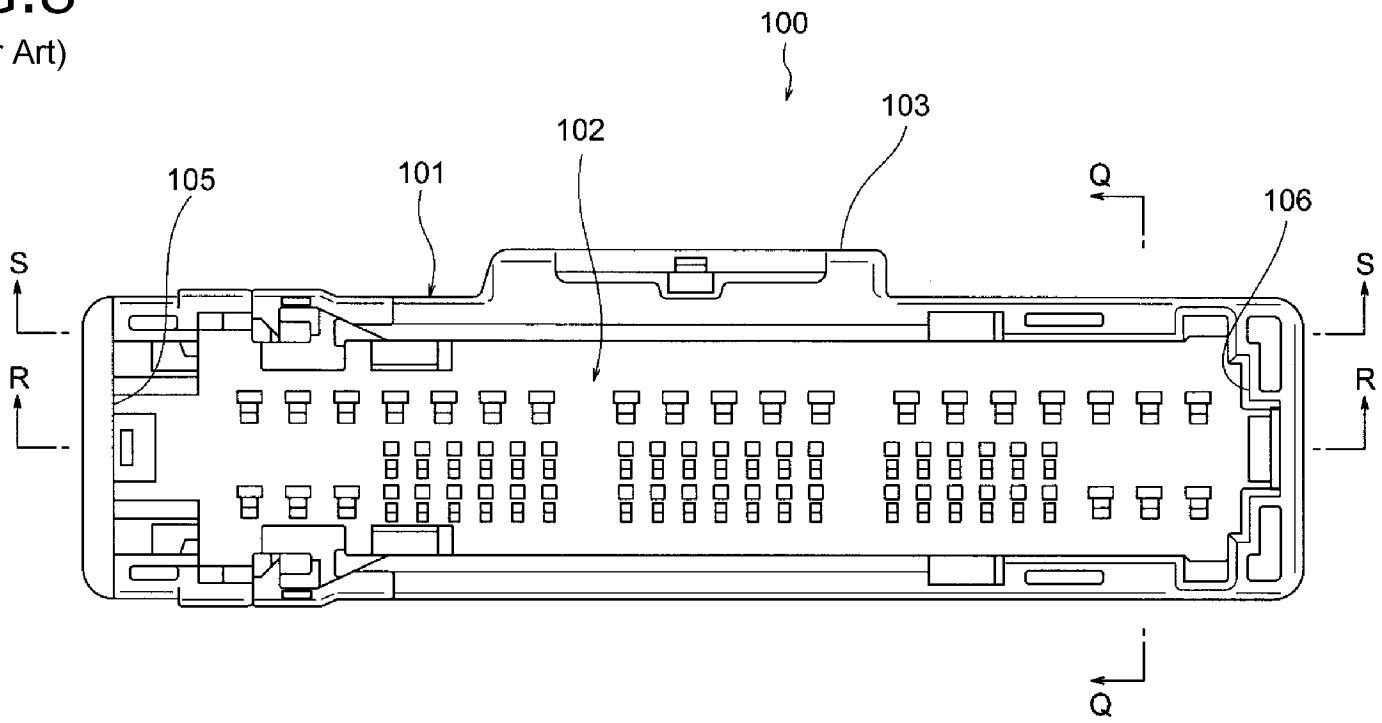
FIG.8 (Prior Art)
FIG. 8 is a front view of the related connector with an aligning plate.
Figure 9:
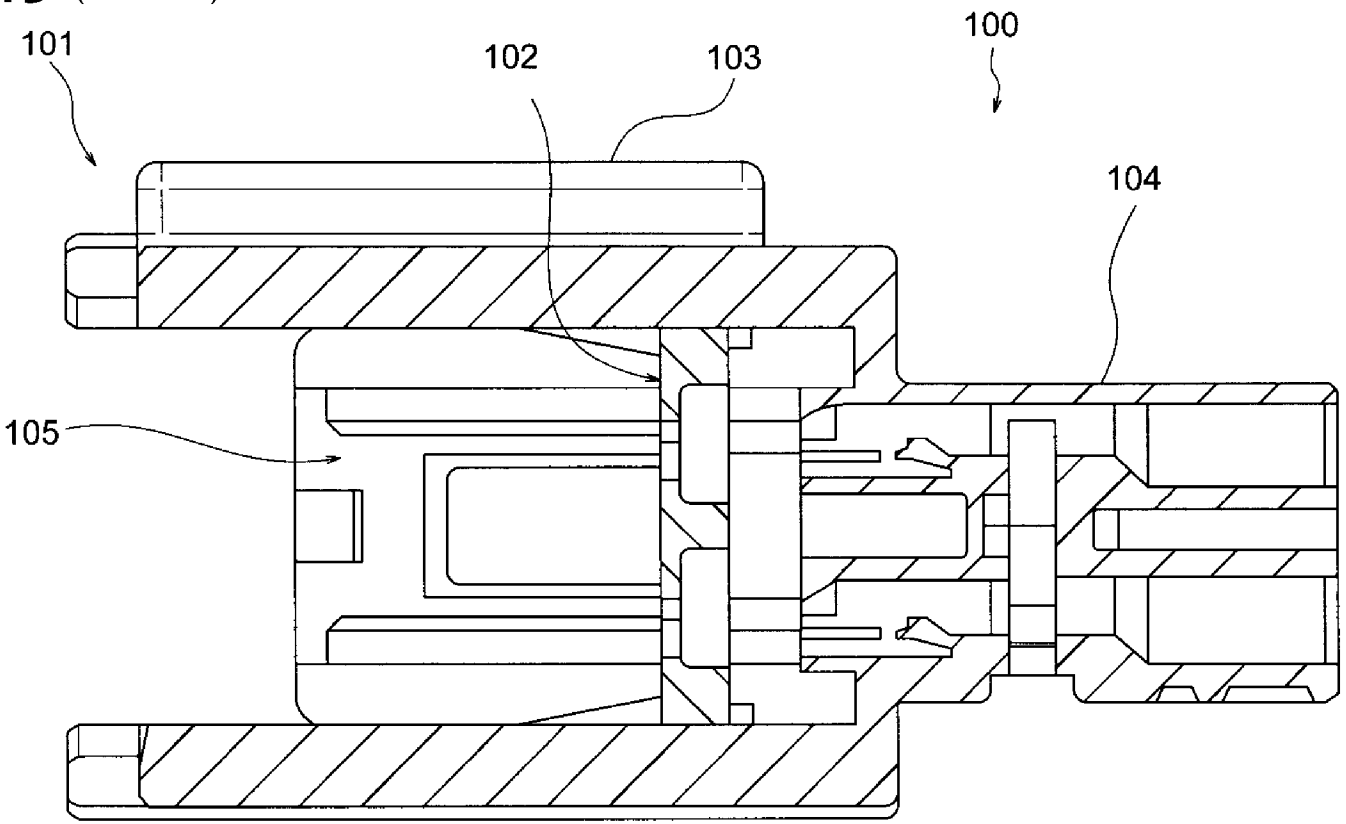
FIG.9 (Prior Art)
FIG. 9 is a sectional view of the related connector along line Q-Q in FIG. 8.

FIG. 1 is an exploded perspective view and a front view, respectively, of the connector with an aligning plate according to the embodiment of the invention. FIGS. 3 to 5 are sectional views of the connector along lines B-B, C-C, and D-D in FIG. 2, respectively. FIG. 6 is an enlarged view of a part of the connector in FIG. 5 in which an aligning plate is engaged with provisional locking arms. In FIGS. 1 to 5, the front-rear, top-bottom, and left-right directions (just examples) are indicated by arrows.

In FIG. 1, reference numeral 1 denotes the connector with an aligning plate according to the embodiment of the invention. The connector 1 with an aligning plate is one used in, for example, the cowl of an automobile. More specifically, the connector 1 with an aligning plate is one used for concentrating many cables (circuits) that are routed in or from what is called the instrument panel, the engine, the floor, etc. In the embodiment, it is assumed that the connector 1 with an aligning plate is a female connector. The connector 1 with an aligning plate is configured so as to be able to be fitted with or disengaged from a counterpart connector (male connector; not shown).

The connector 1 with an aligning plate includes plural (a number of) male terminals (not shown), a connector housing 2, and an aligning plate 3. The individual members will be described below.

First, the male terminals will be described. The male terminals, which are formed by pressing a conductive metal plate, each have a male electric contact portion (not shown) and a cable connection portion (not shown) which is continuous with the male electric contact portion. The male electric contact portion, which corresponds to the term "tip portion of a male terminal" as used in the claims, is formed as a male-shaped portion called a male tab, a pin, or the like. The male electric contact portion is a portion to come into electric contact with a female terminal (not shown) of the counterpart connector. The cable connection portion is a portion to be connected to a terminal of a cable.

Next, the connector housing 2 will be described. The connector housing 2, which is made of an insulative synthetic resin material, includes a hood 4 and a terminal housing portion 5.

Figure 2:
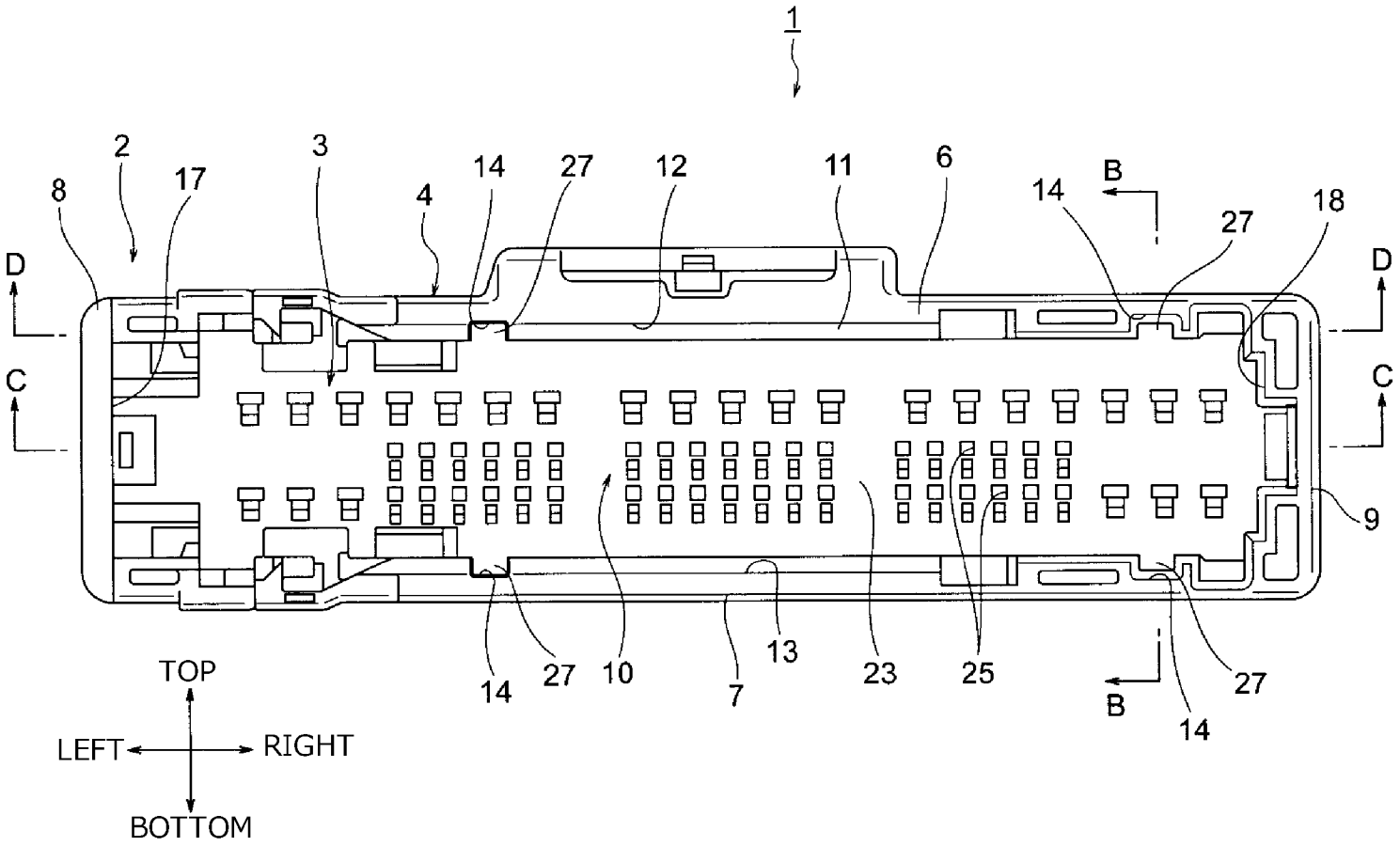
FIG. 2 is a front view of the aligning plate according to the embodiment.
Figure 3:
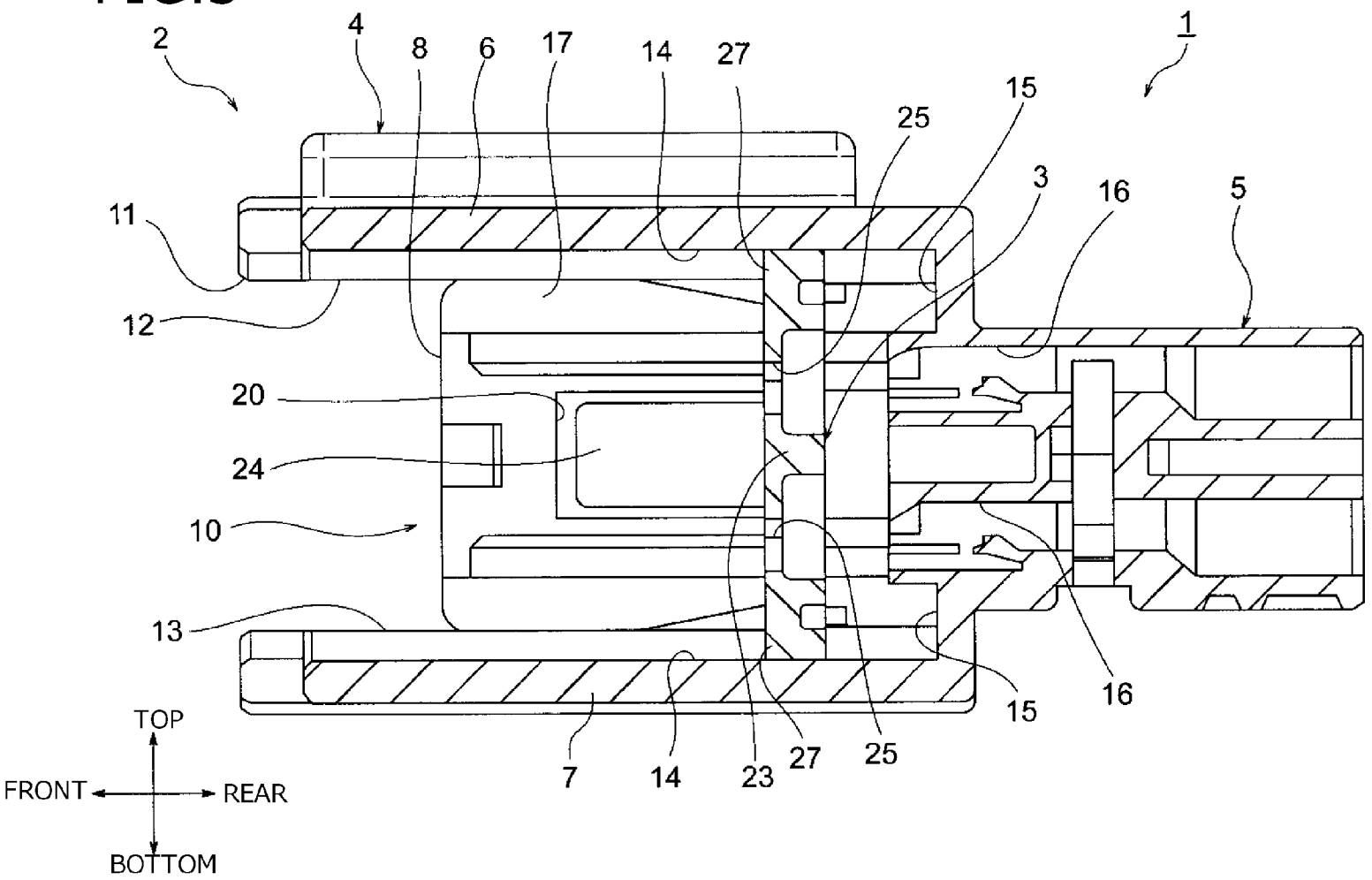
FIG. 3 is a sectional view of the connector along line B-B in FIG. 2.

As illustrated in FIGS. 1 to 3, the hood 4 is shaped like a rectangular cylinder and has a pair of longer-axis-side walls 6 and 7 which extend in the longitudinal direction (left-right direction) of the connector housing 2 and a pair of shorter-axis-side walls 8 and 9 which extend in the shorter-axis direction (top-bottom direction) of the connector housing 2. A counterpart connector fitting room 10 is formed inside the hood 4.

The counterpart connector fitting room 10 is a space into which the counterpart connector is inserted when the connector 1 with an aligning plate is fitted with the counterpart connector.

A counterpart connector insertion opening 11 is formed at the front of the hood 4. The counterpart connector insertion opening 11 is an opening through which the counterpart connector is inserted when the connector 1 with an aligning plate is fitted with the counterpart connector, and is formed so as to be continuous with the counterpart connector fitting room 10.

As illustrated in FIGS. 1 to 5, each of inner surfaces 12 and 13 of the pair of the longer-axis-side walls 6 and 7 is formed with plural recesses 14. The recesses 14 restrict a warp of the terminal housing portion 5 in the insertion direction (indicated by arrow A in FIG. 1) of the counterpart connector.

As illustrated in FIG. 2, the recesses 14 assume a rectangular shape when the connector housing 2 is viewed from the front side. The recesses 14 are shaped so as to be able to guide respective projections 27 (described later) of the aligning plate 3. As illustrated in FIGS. 1 to 5, the recesses 14 are formed so as to extend from the counterpart connector insertion opening 11 to a deep end portion 15 of the counterpart connector fitting room 10 in the insertion direction (front-rear direction; indicated by arrow A in FIG. 1) of the counterpart connector.

The recesses 14 have a prescribed width in the longitudinal direction of the connector housing 2. More specifically, the recesses 14 have such a size as to be able to engage with the respective projections 27 of the aligning plate 3 when as described later the aligning plate 3 is forced to warp in the insertion direction of the counterpart connector.

With the recesses 14 having the above structure, the aligning plate 3 can be set inside the connector housing 2 so as to be movable in the insertion direction of the counterpart connector.

In a state that the aligning plate 3 is provisionally locked on provisional locking arms 19 (described later), the recesses 14 can be engaged with the respective projections 27 (described later) of the aligning plate 3 when the aligning plate 3 is pushed in the insertion direction of the counterpart connector and thereby forced to warp in this direction.

In the embodiment, as illustrated in FIGS. 1 and 2, two recesses 14 (two is just an example) are formed in each of the inner surfaces 12 and 13 of the pair of longer-axis-side walls 6 and 7.

As illustrated in FIGS. 1 and 2, the plural recesses 14 are formed in the inner surfaces 12 and 13 of the pair of longer-axis-side walls 6 and 7 at prescribed positions in the longitudinal direction of the inner surfaces 12 and 13. More specifically, the recesses 14 are formed at positions somewhat distant from the centers, in their longitudinal direction, of the inner surfaces 12 and 13 of the pair of longer-axis-side walls 6 and 7 and at positions close to the positions where the longer-axis-side walls 6 and 7 are connected to the shorter-axis wall 9 (the illustrated positions of the recesses 14 are just examples).

A more specific description will be made of the recesses 14 that are formed near the positions where the pair of longer-axis-side walls 6 and 7 are connected to the shorter-axis wall 9. As illustrated in FIG. 5, it can be said that these recesses 14 are formed the position close to the associated provisional locking arms 19 (described later). With these recesses 14, the aligning plate 3 is not prone to warp in the insertion direction of the counterpart connector even if the aligning plate 3 is pushed in the insertion direction at a position located between the position where these recesses 14 are engaged with the associated projections and the position where the provisional locking arms 19 are engaged with the provisional locking portions 26.

With this configuration, a warp of the aligning plate 3 in the insertion direction (indicated by arrow A in FIG. 1) of the counterpart connector near the positions where the provisional locking arms 19 are engaged with the provisional locking portions 26 can be restricted.

As illustrated in FIGS. 4 and 5, each of inner surfaces 17 and 18 of the pair of shorter-axis-side walls 8 and 9 of the hood 4 is formed with provisional locking arms 19 and a guide groove 20.

The provisional locking arms 19 are portions for holding the aligning plate 3 at a provisional locking position in the counterpart connector fitting room 10. Two provisional locking arms 19 are formed in each of the inner surfaces 17 and 18 of the pair of shorter-axis-side walls 8 and 9 of the hood 4; that is, four provisional locking arms 19 are formed at such positions as to be able to engage with four respective corner portions of the aligning plate 3.

As illustrated in FIGS. 5 and 6, each provisional locking arm 19 has an arm portion 21 and an engagement projection 22. As illustrated in FIGS. 5 and 6, the arm portion 21 is formed so as to be continuous with an approximately middle portion of the inner surface 17 or 18 of the associated shorter-axis-side wall 8 or 9, to be a flexible arm, and to extend toward the deep end portion 15 of the counterpart connector fitting room 10. The arm portion 21 is formed so as to be located outside the associated end (described later), in its longitudinal direction, of the aligning plate 3 when the aligning plate 3 is provisionally locked inside the counterpart connector fitting room 10.

As illustrated in FIGS. 5 and 6, the engagement projection 22 projects to the inside of the hood 4 from the tip of the arm portion 21 and serves as a portion to engage with the associated provisional locking portion 26 (described later) of the aligning plate 3.

As illustrated in FIG. 4, each guide groove 20 is formed in the inner surface 17 or 18 of the shorter-axis-side wall 8 or 9 and is shaped like a rectangle in cross section so as to be able to guide an associated guide portion 24 (described later) of the aligning plate 3.

As illustrated in FIGS. 1 and 2, the terminal housing portion 5 is shaped like a box and is continuous with the deep end portion 15 of the hood 2. As illustrated in FIG. 4, the terminal housing portion 5 is formed with plural (a number of) terminal housing rooms 16 which are formed with respective lances (given no reference numerals) for locking of male terminals. The male terminals are housed in such a manner that male electric contact portions project into the counterpart connector fitting room 10 from the front end of the terminal housing portion 5.

Next, the aligning plate 3 will be described. The aligning plate 3 is made of an insulative synthetic resin material and is also called a moving plate.

The aligning plate 3 is formed so as to be movable in the counterpart connector fitting room 10 in the insertion direction of the counterpart connector and to be able to be locked temporarily at an approximately middle position in the counterpart connector fitting room 10. The aligning plate 3 is formed so as to position and protect the male electric contact portions of the male terminals projecting into the counterpart connector fitting room 10 of the hood 4 in a state that the counterpart connector is not fitted in the connector 1 with an aligning plate.

As illustrated in FIG. 1, the aligning plate 3 includes a plate main body 23 and guide portions 24. As illustrated in FIGS. 1 to 5, the plate main body 23 is a plate-like member whose outward shape conforms to the sectional shape of the hood 4. In the embodiment, the plate main body 23 is a rectangular plate-like member whose sides extending in the longitudinal direction of the connector housing 2 are longer than its sides extending in the shorter-axis direction of the connector housing 2. Plural (a number of) insertion holes 25 through which to insert the male electric contact portions penetrate through the plate main body 23. Furthermore, the plate main body 23 is formed with two pairs of provisional locking portions 26 and plural projections 27.

As illustrated in FIGS. 1, 5, and 6, the provisional locking portions 26 are formed in the back surface of the plate main body 23 and are recessed in cross section. As illustrated in FIGS. 1 and 5, the provisional locking portions 26 are formed at the two ends, in its longitudinal direction, of the aligning plate 3. As illustrated in FIGS. 5 and 6, the provisional locking portions 26 are portions that are locked temporarily at an approximately middle position in the counterpart connector fitting room 10 when engaged with the respective provisional locking arms 19 of the connector housing 2.

The projections 27 are portions for restricting a warp of the aligning plate 3 in the insertion direction (indicated by arrow A in FIG. 1) of the counterpart connector.

As illustrated in FIGS. 1 and 2, the projections 27 are formed on the pair of sides extending in the longitudinal direction (left-right direction) at such positions as to be guided by the respective recesses 14 formed in the hood 4 when the aligning plate 3 is inserted into the counterpart connector fitting room 10 of the hood 4.

As illustrated in FIG. 2, the projections 27 are formed so as to be convex outward when the aligning plate 3 is viewed from the front side. The projections 27 are shaped so as to be guided by the respective recesses 14 formed in the hood 4 of the connector housing 2.

The projections 27 have a prescribed width in the longitudinal direction of the aligning plate 3. More specifically, the projections 27 have such a size as to be able to engage with the respective recesses 14 of the connector housing 2 when as described later the aligning plate 3 is forced to warp in the insertion direction of the counterpart connector.

With the projections 27 having the above structure, the aligning plate 3 can be set inside the connector housing 2 so as to be movable in the insertion direction of the counterpart connector. Furthermore, the projections 27 can be engaged with the respective recesses 14 of the connector housing 2 when the aligning plate 3 is pushed in the insertion direction of the counterpart connector and thereby forced to warp in the insertion direction.

In the embodiment, as illustrated in FIGS. 1 and 2, two projections 27 (two is just an example) are formed on each of the two sides, extending in its longitudinal direction, of the aligning plate 3.

As illustrated in FIGS. 1 and 2, the plural projections 27 are formed at such positions as to correspond to the respective recesses 14 which are formed in the hood 4 of the connector housing 2. More specifically, the projections 27 are formed at positions somewhat distant from the centers of the two sides, extending in its longitudinal direction, of the aligning plate 3 and at positions close to provisional locking portions 26 of the aligning plate 3.

A more specific description will be made of the projections 27 that are formed at the position close to the provisional locking portions 26 of the aligning plate 3. As illustrated in FIG. 5, it can be said that these projections 27 are formed at the position close to the position where the associated provisional locking portions 26 of the aligning plate 3 engage with the associated provisional locking arms 19. With these projections 27, the aligning plate 3 is not prone to warp in the insertion direction of the counterpart connector even if the aligning plate 3 is pushed in the insertion direction at a position located between the position where these recesses 14 are engaged with the projections 27 and the position where the provisional locking arms 19 are engaged with the provisional locking portions 26.

With this configuration in which the projections 27 are formed near provisional locking portions 26 of the aligning plate 3 (the illustrated positions of the projections 27 are just examples), a warp of the aligning plate 3 in the insertion direction (indicated by arrow A in FIG. 1) of the counterpart connector near the positions where the provisional locking portions 26 are engaged with the provisional locking arms 19 can be restricted.

The guide portions 24 are flexible pieces and are formed so as to be located on the opposite side to the provisional locking portions 26, that is, on the front side of the plate main body 23. The guide portions 24 are formed at such positions as to be guided by the respective guide grooves 20 of the shorter-axis-side walls 8 and 9 of the connector housing 2.

Next, a description will be made of a procedure of work of provisionally locking the aligning plate 3 in the counterpart connector fitting room 10 of the connector housing 2.

First, the aligning plate 3 is inserted into the counterpart connector fitting room 10 through the counterpart connector insertion opening 11 of the connector housing 2 by moving it in the direction indicated by arrow A in FIG. 1. When the aligning plate 3 has been inserted to the approximately middle position in the counterpart connector fitting room 10, as illustrated in FIGS. 3 and 4 the guide portions 24 of the aligning plate 3 come to be guided by the respective guide grooves 20 of the inner surfaces 17 and 18 of the pair of shorter-axis-side walls 8 and 9. Furthermore, as illustrated in FIG. 5, the provisional locking arms 19 of the connector housing 2 are engaged with the provisional locking portions 26 of the aligning plate 3.

Thus, the work of provisionally locking the aligning plate 3 in the counterpart connector fitting room 10 of the connector housing 2 is completed.

Next, a description will be made of how the individual portions operate when the aligning plate 3 is pushed in the insertion direction of the counterpart connector in a state that the aligning plate 3 is provisionally locked in the counterpart connector fitting room 10 of the connector housing 2.

As illustrated in FIG. 4, when a handling person pushes the aligning plate 3 in the insertion direction (indicated by arrow E in FIG. 4) of the counterpart connector in a state that the aligning plate 3 is provisionally locked in the counterpart connector fitting room 10 of the connector housing 2, force acts on the aligning plate 3 in such a direction as to warp the aligning plate 3 in the insertion direction of the counterpart connector.

Figure 10:
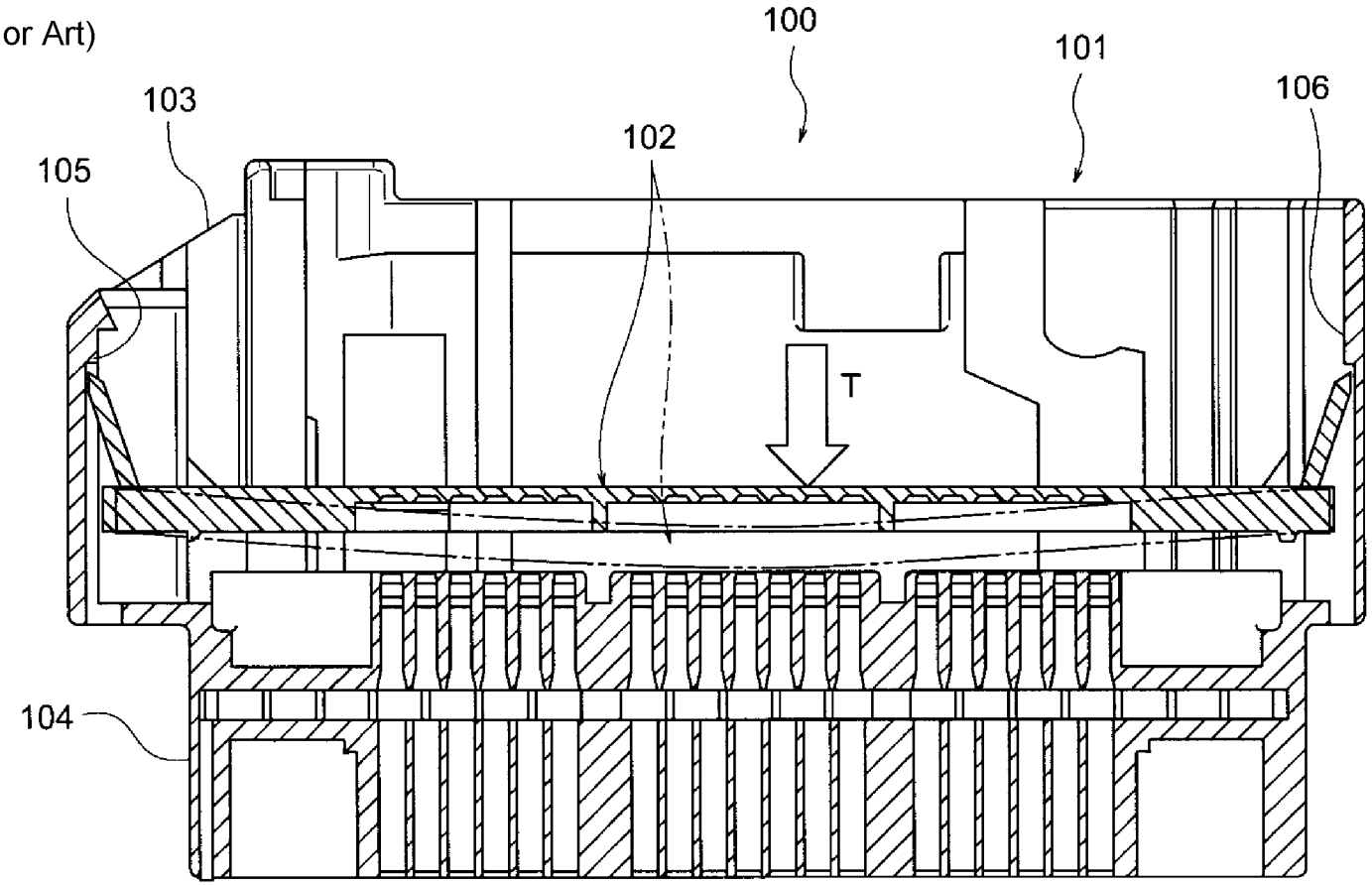
FIG.10 (Prior Art)
FIG. 10 is a sectional view of the related connector along line R-R in FIG. 8.
Figure 11:
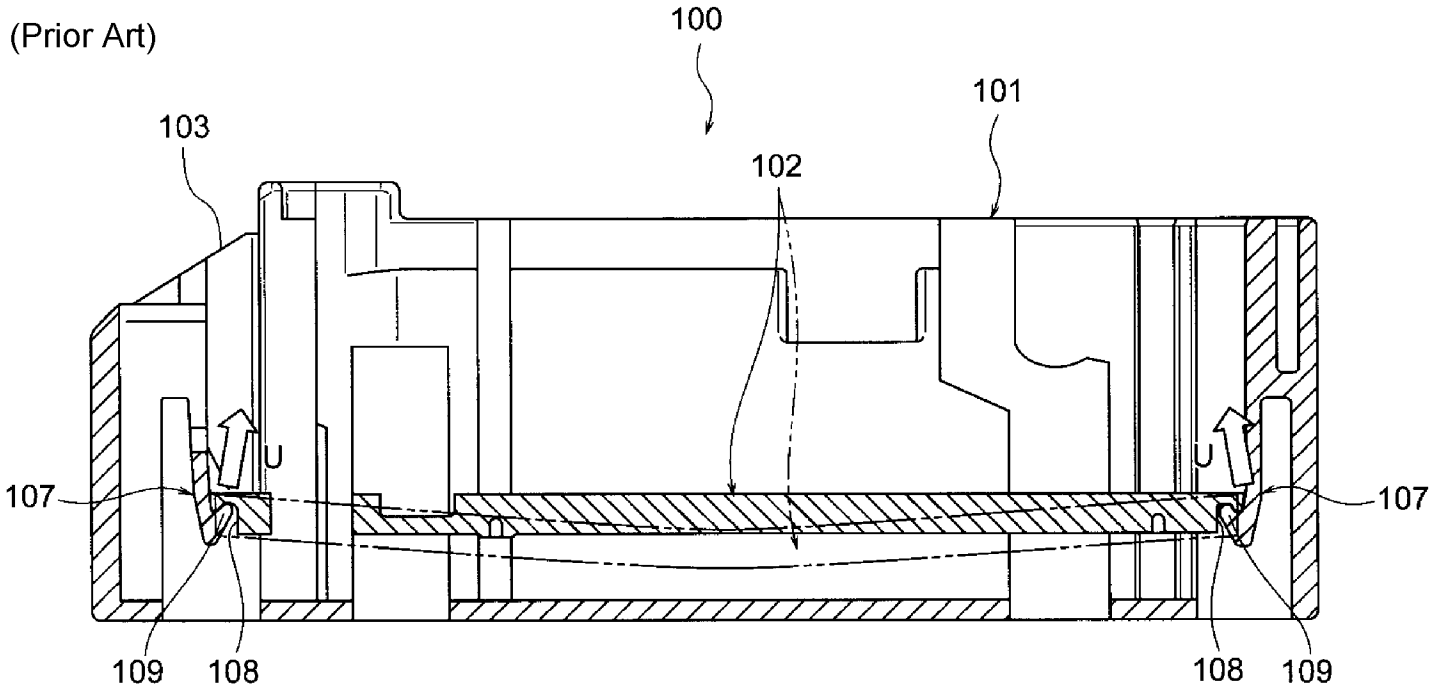
FIG.11 (Prior Art)
FIG. 11 is a sectional view of the related connector along line S-S in FIG. 8.
Figure 12:
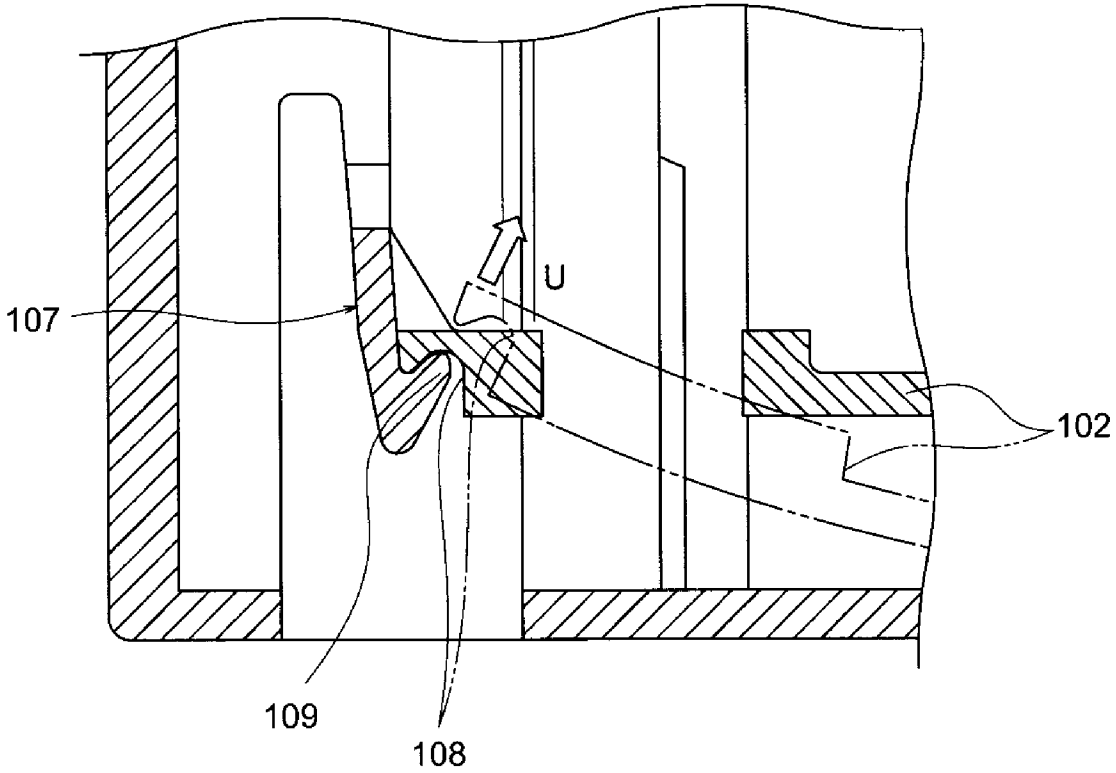
FIG.12 (Prior Art)
FIG. 12 is an enlarged view of a part of the related connector in FIG. 11 in which an aligning plate is engaged with provisional locking arms.

Now, FIGS. 10 to 12 will be referred to for the purpose of comparison with the embodiment. In the related connector 100, referring to FIG. 10, when the aligning plate 102 is pushed in the insertion direction (indicated by arrow T in FIG. 10) of the counterpart connector, the aligning plate 102 is warped in the insertion direction of the counterpart connector as indicated by imaginary lines. At the same time, as indicated in FIG. 11, both end portions, in its longitudinal direction, of the aligning plate 102 rotate in the directions indicated by arrow U in FIG. 11 with the tips of the engagement projections 109 of the provisional locking arms 107 as rotation axes. As a result, the engagement widths (margins) of the provisional locking portions 108 of the aligning plate 102 and the engagement projections 109 of the provisional locking arms 107 are shortened.

If the aligning plate 102 is pushed further in the insertion direction of the counterpart connector, both end portions of the aligning plate 102 rotate further in the directions indicated by arrow U in FIG. 12 with the tips of the engagement projections 109 of the provisional locking arms 107 as rotation axes. As indicated by imaginary lines in FIG. 12, this results in a problem that the provisional locking portions 108 of the aligning plate 102 are disengaged from the respective engagement projections 109 of the provisional locking arms 107.

In contrast, in the connector 1 with an aligning plate according to the embodiment, since as illustrated in FIGS. 2 to 5 the projections 27 of the aligning plate 3 are guided by the respective recesses 14 of the connector housing 2, the recesses 14 are engaged with the projections 27 when the aligning plate 3 is pushed in the insertion direction of the counterpart connector and thereby forced to warp in the insertion direction. Therefore, as indicated by imaginary lines in FIGS. 5 and 6, a warp of the aligning plate 3 in the insertion direction is restricted. Thus, an action is restricted that both end portions, in its longitudinal direction, of the aligning plate 3 rotate in the directions indicated by arrow F in FIG. 5 with the tips of the engagement projections 22 of the provisional locking arms 19 as rotation axes.

Even if the aligning plate 3 is pushed further in the insertion direction of the counterpart connector, the force of warping the aligning plate 3 in the insertion direction causes the recesses 14 to be engaged with the respective projections 27 more strongly (see FIG. 5). As a result, as indicated by imaginary lines in FIG. 6, the engagement is maintained with the engagement widths (margins) of the provisional locking portions 26 of the aligning plate 3 and the engagement projections 22 of the provisional locking arms 19 kept longer than in the related connector 100 illustrated in FIGS. 7 to 12.

Thus, even if the aligning plate 3 is pushed in the insertion direction of the counterpart connector, the state that the aligning plate 3 is provisionally locked in the counterpart connector fitting room 10 of the connector housing 2 is maintained.

Incidentally, if the recesses 14 and the projections 27 were formed at positions that are distant from the provisional locking arms 19 and the provisional locking portions 26 unlike in the case illustrated in FIG. 5, if the aligning plate 3 is pushed in the insertion direction of the counterpart connector at a position located between a recess 14/projection 27 and provisional locking arms 19/provisional locking portions 26, the aligning plate 3 would warp in the insertion direction of the counterpart connector in the region between the recess 14/projection 27 and the provisional locking arms 19/provisional locking portions 26.

That is, if the recesses 14 and the projections 27 were formed at positions that are distant from the provisional locking arms 19 and the provisional locking portions 26, a warp of the aligning plate 3 in the insertion direction could not be restricted and the provisional locking portions 26 might be disengaged from the provisional locking arms 19.

In contrast, in the embodiment, since as illustrated in FIG. 5 the recesses 14 and the projections 27 are formed near the provisional locking arms 19 and the provisional locking portions 26, when the aligning plate 3 is pushed in the insertion direction of the counterpart connector, a warp of the aligning plate 3 in the insertion direction of the counterpart connector near the positions where the provisional locking arms 19 are engaged with the provisional locking portions 26 can be restricted.

As a result, even if the aligning plate 3 is pushed in the insertion direction of the counterpart connector at a position located between a recess 14/projection 27 and provisional locking arms 19/provisional locking portions 26, the state that the aligning plate 3 is provisionally locked in the counterpart connector fitting room 10 of the connector housing 2 can be maintained more reliably.

As described above with reference to FIGS. 1 to 6, according to the invention, even if the aligning plate 3 is pushed in the insertion direction of the counterpart connector in a state that the aligning plate 3 is engaged with the provisional locking arms 19, a warp of the aligning plate 3 in the insertion direction of the counterpart connector can be restricted because the recesses 14 formed in the connector housing 2 are fitted with the projections 27 formed in the aligning plate 3. As a result, the aligning plate 3 can be prevented from being disengaged from the provisional locking arms 19.

This provides an advantage that the engagement between the alignment plate 3 and the provisional locking arms 19 can be maintained.

This also provides an advantage that the protection of the male terminals and the positioning of them at prescribed positions by the aligning plate 3 are made reliable.

Furthermore, according to the invention, since a warp of the aligning plate 3 in the insertion direction of the counterpart connector near the positions where the provisional locking arms 19 are engaged with the provisional locking portions 26 is restricted, the provisional locking portions 26 can be prevented more reliably from being disengaged from the provisional locking arms 19 even if the aligning plate 3 is pushed in the insertion direction of the counterpart connector. This provides an advantage that the engagement between the alignment plate 3 and the provisional locking arms 19 can be maintained more reliably.

It goes without saying that various modifications are possible without departing from the spirit and scope of the invention.

Although in the above embodiment the connector housing 2 is formed with the plural recesses 14 and the aligning plate 3 is formed with the plural projections 27, the invention is not limited to this configuration and may be implemented in the following manner.

Although not illustrated by any drawings, a configuration is possible in which the inner surfaces of the pair of longer-axis-side walls of the connector housing are formed with projections in the form of ribs that extend in the insertion direction of the counterpart connector and the pair of sides (outer edges), extending in its longitudinal direction, of the aligning plate are formed with recesses in such a manner that they can guide the respective projections.

With these recesses and projections, the aligning plate can be set inside the connector housing so as to be movable in the insertion direction of the counterpart connector.

The recesses come to be engaged with the respective projections when the aligning plate is pushed in the insertion direction of the counterpart connector and thereby forced to warp in the insertion direction in a state that the aligning plate is provisionally locked on the provisional locking arms of the connector housing.

Furthermore, since the projections are shaped like ribs that extend in the insertion direction of the counterpart connector, the recesses are not disengaged from the respective projections in the connector housing, whereby the aligning plate is attached to the connector housing stably.

In this modification, since the projections are shaped like ribs that extend in the insertion direction, the projections are not disengaged from the respective recesses in the connector housing even if the aligning plate is forced to warp in the insertion direction. As a result, the engagement between the provisional locking arms and the provisional locking portions can be maintained more reliably. This means that the engagement between the alignment plate and the provisional locking arms can be maintained more reliably.

Furthermore, since the projections are shaped like ribs that extend in the insertion direction and the recesses are formed so as to be able to guide the respective projections, this modification provides an advantage that the efficiency of work of attaching the aligning plate to the connector housing is increased.

Still further, since the projections are shaped like ribs that extend in the insertion direction, this modification provides an advantage that a connector housing manufacturing die can be opened without causing any trouble. This means increased connector manufacturing efficiency.

What is claimed is:

1. A connector comprising:

a connector housing that is configured to house plural male terminals therein and configured to receive a counterpart connector; and an aligning plate that is provided so as to be movable in an insertion direction of the counterpart connector into the connector housing and configured to position tip portions of the male terminals in the connector housing, wherein the connector housing comprises a pair of provisional locking arms which hold the aligning plate at a provisional locking position, and the aligning plate comprises provisional locking portions which engage with the pair of provisional locking arms;

wherein the connector housing and the aligning plate are provided with plural recesses and plural projections; and wherein the plural recesses and plural projections are mutually engaged when the aligning plate is pushed in the insertion direction in a state that the aligning plate is held at the connector housing at the provisional locking position so that a warp of the aligning plate in the insertion direction is restricted.

2. The connector according to claim 1, wherein the recesses provided on a longer axis side wall in the connector housing and the projections provided on an edge of the aligning plate extending along a longitudinal direction of the aligning plate are provided at positions near the provisional locking arms provided on shorter axis side walls in the connector housing or the provisional locking portions of the aligning plate.

3. The connector according to claim 1, wherein the projections are formed in inner wall surfaces of the connector housing and shaped like ribs extending in the insertion direction; and wherein the recesses are formed in outer edges of the aligning plate so as to guide the projections.

* * * * *